US008680031B1

(12) United States Patent
Poli

(10) Patent No.: US 8,680,031 B1
(45) Date of Patent: Mar. 25, 2014

(54) EXFOLIATING COMPOSITIONS COMPRISING A TERNARY MIXTURE OF INORGANIC EXFOLIANTS

(71) Applicant: Roanoke College, Salem, VA (US)

(72) Inventor: DorothyBelle Poli, Roanoke, VA (US)

(73) Assignee: Roanoke College, Salem, VA (US)

( * ) Notice: Subject to any disclaimer, the term of this patent is extended or adjusted under 35 U.S.C. 154(b) by 0 days.

(21) Appl. No.: 13/800,274

(22) Filed: Mar. 13, 2013

Related U.S. Application Data

(60) Provisional application No. 61/612,624, filed on Mar. 19, 2012.

(51) Int. Cl.
*C11D 3/08* (2006.01)
*C11D 3/14* (2006.01)
*C11D 9/20* (2006.01)

(52) U.S. Cl.
USPC ..... 510/139; 510/130; 510/132; 510/133; 510/138; 510/141; 510/236; 510/268; 510/368; 510/377; 510/395; 510/396; 510/485; 510/511; 510/532

(58) Field of Classification Search
USPC ..... 510/130, 132, 133, 138, 139, 141, 236, 510/268, 368, 377, 395, 396, 485, 511, 532
See application file for complete search history.

(56) References Cited

U.S. PATENT DOCUMENTS

| | | | | |
|---|---|---|---|---|
| 2,188,140 | A | 1/1940 | Widmer | |
| 4,181,633 | A * | 1/1980 | Colodney et al. | 510/397 |
| 4,438,016 | A * | 3/1984 | Kiewert et al. | 510/369 |
| 4,786,432 | A | 11/1988 | Kanfer et al. | |
| 5,669,942 | A * | 9/1997 | McCullough | 51/307 |
| 6,673,756 | B2 | 1/2004 | Sonnenberg et al. | |
| 7,871,969 | B2 | 1/2011 | Myers | |
| 2002/0052300 | A1 | 5/2002 | Kemper et al. | |
| 2005/0172564 | A1 * | 8/2005 | Collins et al. | 51/307 |
| 2007/0203040 | A1 | 8/2007 | Reicherz et al. | |
| 2011/0240916 | A1 | 10/2011 | Constantz et al. | |

* cited by examiner

*Primary Examiner* — Charles Boyer
(74) *Attorney, Agent, or Firm* — Charles S. Sara, Esq.; Daniel A. Blasiole; DeWitt Ross & Stevens

(57) ABSTRACT

Exfoliating compositions, such as soaps, scrubs, and muds, for conditioning skin. The compositions include a carrier and particles that are insoluble in the carrier. The carrier may include one of more of a surfactant and an emollient, among other ingredients. The particles preferably include calcium carbonate, one or more phyllosilicates, and a quartz group tectosilicate, preferably have a calcium carbonate equivalent of less than 90%, and preferably embody a schistose texture. The exfoliating compositions with such particles have unexpected moisturizing and skin-conditioning properties.

19 Claims, No Drawings

EXFOLIATING COMPOSITIONS COMPRISING A TERNARY MIXTURE OF INORGANIC EXFOLIANTS

CROSS-REFERENCE TO RELATED APPLICATIONS

This application claims priority under 35 USC §119(e) to U.S. Provisional Patent Application 61/612,624 filed Mar. 19, 2012, the entirety of which is incorporated herein by reference.

FIELD OF THE INVENTION

The present invention is directed to exfoliating compositions such as soaps, scrubs, and creams for use on the skin.

BACKGROUND

Soap dates back to Babylonian times and has undergone many changes. Exfoliating soap has been manufactured by major US soap companies to help with skin appearance. Dead skin is scoured off by exfoliation which allows moisturizing agents to reach fresh skin cells. Exfoliation works on all skin types and colors. Common natural material used for exfoliates has ranged from salt, grains, apricot pits, seeds, sand, walnut shells, and fish scales. These products have a hardness rating of 4 or higher on the Mohs Scale of Mineral Hardness. Therefore the harder the exfoliate, the more damage it could potentially do to the skin. Some companies make synthetic exfoliation products that are lipid based microbeads (1-2 Mohs Scale) which tend to be the most gentle of abrasives but do not work well with more difficult exfoliation needs.

One natural abrasive, calcium carbonate, can be extracted from materials like limestone (3 on Mohs Scale) or marble (9 on Mohs Scale) and can be found within a few commercial soaps or scrubs. See, e.g., U.S. Pat. No. 6,673,756 to Sonnenberg et al., U.S. Pat. No. 7,871,969 to Myers, U.S. Pat. No. 2002/0052300 to Kemper et al., U.S. Pat. No. 2007/0203040 to Reicherz et al., U.S. Pat. No. 4,786,432 to Kanfer et al., U.S. Pat. No. 2,188,140 to Widmer. Mining for calcium carbonate is a process that strips the earth of natural resources. This process adds to pollution due to the need for further chemical processing of the stone to make a "pure" calcium carbonate.

An exfoliating composition that does not have the aforementioned disadvantages of conventional exfoliating compositions is needed.

SUMMARY OF THE INVENTION

Quarry products typically consist of rock particles larger than 14 mm in size, i.e., rock particles retained by a 14-mm sieve. The material passing through the 14-mm sieve is typically referred to as "fines" and is often hauled away as a byproduct and waste. Most of these fines are dust particles that result from stone-crushing processes. The present invention preferably uses the fines from quarry operations as an exfoliation additive for skin-conditioning compositions. Specific marble waste fines obtained from the Lawyers Road Quarry (762 Lawyers Road, Lynchburg, Va. 24501) of Boxley Materials Company (15418 West Lynchburg Salem Turnpike, Blue Ridge, Va. 24064) was found by the inventors to exhibit unexpected moisturizing, softening, and conditioning properties on skin compared to other exfoliants. Accordingly, certain versions of the present invention include the Lawyers Road fines, or fines having a similar composition, as an exfoliant.

A preferred exfoliating composition of the invention comprises a carrier and particles that are insoluble in the carrier. The carrier comprises one of more of a surfactant and an emollient. The particles comprise calcium carbonate in an amount of from about 40% to about 90% by mass, one or more phyllosilicates in a total amount of from about 1% to about 50% by mass, a quartz group tectosilicate in an amount of from about 1% to about 35% by mass, and a calcium carbonate equivalent of less than about 90%.

In some versions of the invention, the particles comprise the calcium carbonate in the form of calcite in an amount of from about 55% to about 75% by mass.

In some versions of the invention, the particles have a calcium carbonate equivalent of less than about 75%.

In some versions of the invention, the one or more phyllosilicates comprise one or more of illite and a mica group phyllosilicate in a total amount of from about 1% to about 35% by mass.

In some versions of the invention, the one or more phyllosilicates comprise a chlorite group phyllosilicate in an amount of from about 1% to about 15% by mass.

In some versions of the invention, the one or more phyllosilicates comprise one or more of illite and a mica group phyllosilicate in a total amount of from about 1% to about 35% by mass and further comprise a chlorite group phyllosilicate in an amount of from about 1% to about 15% by mass.

In some versions of the invention, the particles comprise less than about 1% by weight of each of a serpentine group phyllosilicate, halloysite, kaolinite, montmorillonite, vermiculite, talc, palygorskite, and pyrophyllite.

In some versions of the invention, the particles comprise less than about 10% by weight of dolomite.

In some versions of the invention, the particles comprise less than about 2.5% by weight of pyrite and less than about 1% by weight of each of siderite, plagioclase feldspar, K-feldspar, clinoamphibole, and orthoamphibole.

In some versions of the invention, the particles embody a foliated texture, such as a schistose texture.

In some versions of the invention, the particles comprise calcium carbonate in a form of calcite in an amount of from about 60% to about 67% by mass, a calcium carbonate equivalent of from about 55% to about 75%, one or more of illite and a mica group phyllosilicate in a total amount of from about 8% to about 14% by mass, a chlorite group phyllosilicate in an amount of from about 3% to about 9% by mass, a quartz group tectosilicate in an amount of from about 7% to about 13% by mass, less than about 5% by weight of dolomite, and less than about 1% of pyrite. Such particles are preferably substantially devoid of each of a serpentine group phyllosilicate, halloysite, kaolinite, montmorillonite, vermiculite, talc, palygorskite, pyrophyllite, siderite, plagioclase feldspar, K-feldspar, clinoamphibole, and orthoamphibole. Such particles preferably embody a schistose texture.

In some versions of the invention, the carrier further comprises one or more of a preservative, an antimicrobial, and a whitener.

In some versions of the invention, the carrier is in a liquid phase form.

In some versions of the invention, the carrier is in a solid phase form.

In some versions of the invention, the particles are evenly dispersed within the carrier.

In some versions of the invention, the particles are unevenly dispersed within the carrier.

In some versions of the invention, at least about 90% by mass of the particles are capable of passing through a 0.60-mm sieve (30 U.S. Standard mesh sieve), at least about 85% by mass of the particles are capable of passing through a 0.30-mm sieve (50 U.S. Standard mesh sieve), at least about 80% by mass of the particles are capable of passing through a 0.15-mm sieve (100 U.S. Standard mesh sieve), and at least about 70% by mass of the particles are capable of passing through a 0.074-mm sieve (200 U.S. Standard mesh sieve). In addition, at least about 1% by mass of the particles are capable of being retained by a 0.60-mm sieve (30 U.S. Standard mesh sieve), at least about 5% by mass of the particles are capable of being retained by a 0.30-mm sieve (50 U.S. Standard mesh sieve), at least about 10% by mass of the particles are capable of being retained by a 0.15-mm sieve (100 U.S. Standard mesh sieve), and at least about 20% by mass of the particles are capable of being retained by a 0.074-mm sieve (200 U.S. Standard mesh sieve).

The objects and advantages of the invention will appear more fully from the following detailed description of the preferred embodiment of the invention made in conjunction with the accompanying drawings.

DETAILED DESCRIPTION OF THE INVENTION

The exfoliating composition of the present invention comprises insoluble particles in a carrier. The carrier may take the form of a solid soap, a liquid soap, a skin scrub, a mud mask, a cream, a paste, a gel, or any other carrier that is either inert to the skin or cleanses or conditions the skin.

In some versions of the invention, particularly those in which the carrier takes the form of a soap or cleanser, the carrier comprises a surfactant. The surfactant provides a cleansing property to the carrier. The surfactant is an amphiphilic compound that comprises a hydrophilic head and a hydrophobic tail.

The hydrophilic head may comprise a polar, nonionic head group or an ionic head group. The ionic head group may be an anionic head group, a cationic head group, or a zwitterionic head group.

The nonionic head groups may include hydroxyl groups or other polar groups. Examples of surfactants that comprise a nonionic head group include long chain alcohols, such as cetyl alcohol, stearyl alcohol, cetostearyl alcohol (consisting predominantly of cetyl and stearyl alcohols), and oleyl alcohol; polyoxyethylene glycol alkyl ethers (Brij), such as those having the formula $CH_3—(CH_2)_{10-16}—(O—C_2H_4)_{1-25}—OH$, including octaethylene glycol monododecyl ether and pentaethylene glycol monododecyl ether, among others; polyoxypropylene glycol alkyl ethers, such as those having the formula $CH_3—(CH_2)_{10-16}—(O—C_3H_6)_{1-25}—O$; glucoside alkyl ethers, such as those having the formula $CH_3—(CH_2)_{10-16}—(O\text{-Glucoside})_{1-3}\text{-}OH$, including decyl glucoside, lauryl glucoside, and octyl glucoside, among others; polyoxyethylene glycol octylphenol ethers, such as those having the formula $C_8H_{17}—(C_6H_4)—(O—C_2H_4)_{1-25}—OH$, including Triton X-100, among others; polyoxyethylene glycol alkylphenol ethers, such as those having the formula $C_9H_{19}—(C_6H_4)—(O—C_2H_4)_{1-25}—OH$, including nonoxynol-9, among others; glycerol alkyl esters, such as glyceryl laurate, among others; polyoxyethylene glycol sorbitan alkyl esters, such as polysorbate, among others; sorbitan alkyl esters, such as Spans, among others; cocamide MEA; cocamide DEA; codecyldimethylamine oxide; block copolymers of polyethylene glycol and polypropylene glycol, such as poloxamers, among others; and polyethoxylated tallow amine (POEA).

The anionic head groups may include sulfate, sulfonate, phosphate, and/or carboxylate groups, among others. Examples of surfactants that comprise an anionic head group include alkyl sulfates, such as ammonium lauryl sulfate, sodium lauryl sulfate (SDS, sodium dodecyl sulfate), alkyl-ether sulfates such as sodium laureth sulfate, and sodium myreth sulfate, among others. Examples of surfactants that comprise an anionic head group also include sulfonates, such as dioctyl sodium sulfosuccinate, perfluorooctanesulfonate (PFOS), perfluorobutanesulfonate, and linear alkylbenzene sulfonates (LABs), among others. Carboxylates are preferred surfactants. Carboxylates comprise alkyl carboxylates, such as fatty acids and salts thereof. Examples of carboxylates include sodium stearate, sodium lauroyl sarcosinate, and carboxylate-based fluorosurfactants, such as perfluorononanoate, and perfluorooctanoate (PFOA or PFO). Preferred anionic surfactants include cocoyl isethionate, sodium dodecylbenzinesulfonate, and sodium isethionate.

The cationic head groups may include pH-dependent primary, secondary, or tertiary amines and permanently charged quaternary ammonium cations, among others. Primary amines become positively charged at pH<10, secondary amines become positively charged at pH<4. An example of a pH-dependent amine is octenidine dihydrochloride. Permanently charged quaternary ammonium cations include alkyltrimethylammonium salts, such as cetyl trimethylammonium bromide (CTAB, hexadecyl trimethyl ammonium bromide), cetyl trimethylammonium chloride (CTAC), cetylpyridinium chloride (CPC), benzalkonium chloride (BAC), benzethonium chloride (BZT), 5-Bromo-5-nitro-1,3-dioxane, dimethyldioctadecylammonium chloride, cetrimonium bromide, and dioctadecyldimethylammonium bromide (DODAB), among others.

Zwitterionic (amphoteric) surfactants have both cationic and anionic centers attached to the same molecule. The cationic center may be based on primary, secondary, or tertiary amines, quaternary ammonium cations, or others. The anionic part may include sulfonates, as in CHAPS (3-[(3-Cholamidopropyl)dimethylammonio]-1-propanesulfonate), or sultaines, as in cocamidopropyl hydroxysultaine. Other examples of zwitterionic head groups include betaines, such as cocamidopropyl betaine, and choline-phosphates, such as those occurring in lecithin, among others.

For ionic head groups, the counter-ion can be monoatomic/inorganic or polyatomic/organic. Monoatomic/inorganic cationic counter-ions include metals, such as the alkali metals, alkaline earth metals, and transition metals. Monoatomic/inorganic anionic counter-ions include the halides, such as chloride ($Cl^-$), bromide ($Br^-$), and iodide ($I^-$). Polyatomic/organic cationic counter-ions include ammonium, pyridinium, and triethanolamine (TEA), among others. Polyatomic/organic anionic counter-ions include tosyls, trifluoromethanesulfonates, and methylsulfate, among others.

The hydrophobic tail of the surfactant may include a linear, branched, or aromatic hydrocarbon chain. The hydrocarbon chain may have any number of carbon atoms suitable to render it hydrophobic. The number of carbon atoms may include from 9 to 30 carbon atoms, from 10 to 20 carbon atoms, or from 12 to 18 carbon atoms. Such carbon atoms may be saturated, unsaturated, straight-chained, branched, or cyclic.

The surfactant may comprise natural surfactant and/or a synthetic surfactant. As used herein, "natural surfactant" refers to a saponified animal or vegetable fat or purified components thereof. "Synthetic surfactant" refers to a surfactant that is not a natural surfactant. The animal or vegetable fat used to generate the natural surfactant may be a solid fat or a liquid fat (i.e., an oil). Examples of solid fats include lard, tallow, and vegetable shortening, among others. Examples of liquid fats include oils such as coconut oil, peanut oil, almond oil, palm oil, olive oil, and soybean oil, among others. Other suitable fats include apricot kernel, sweet almond, jojoba, evening primrose, wheat germ, avocado, shea butter, and coconut butter, among others. To generate the natural surfactant, the fats are saponified, i.e., hydrolyzed, with a strong base. Lye is a suitable strong base. Caustic soda (sodium hydroxide) and caustic potash (potassium hydroxide) are both examples of lye. Saponification of fat results in a saponified fat composition. The saponified fat composition may comprise fatty acids or salts thereof, glycerol, any cations remaining from the saponification, such as sodium and/or potassium, and/or any non-hydrolyzed fat. The sodium and potassium may be complexed with the fatty acid to form a fatty salt or may be free ions. The glycerol may or may not be removed from the saponified fat. The saponified fat composition or components thereof may be used in whole or in part as the carrier.

Different fatty acids give the resulting carrier different properties and textures. Longer-chain fatty acid molecules, such as those in saponified lard, make a carrier that is very hard and somewhat difficult to dissolve in water (lather). Shorter fatty acid molecules, such as those in saponified coconut oil, create a soap that is softer and easier to lather. Different oils can be combined to create carriers with the desired softness and lathering properties.

The strong base used in the saponification also gives the resulting carrier different properties and textures. Potash tends to make a softer carrier, while caustic soda produces a harder carrier.

The surfactant may be included in the carrier in an amount of from about 5% to about 100% by weight, such as about 5% by weight, about 10% by weight, about 15% by weight, about 20% by weight, about 25% by weight, about 30% by weight, about 35% by weight, about 40% by weight, about 45% by weight, about 50% by weight, about 55% by weight, about 60% by weight, about 65% by weight, about 70% by weight, about 75% by weight, about 80% by weight, about 85% by weight, about 90% by weight, about 95% by weight, or about 100% by weight.

The carrier may also include water. Water may be present in the carrier in an amount of from about 1% to about 90% by weight, such as an amount of from about 5% to about 80% by weight. Examples include about 5% by weight, about 10% by weight, about 15% by weight, about 20% by weight, about 25% by weight, about 30% by weight, about 35% by weight, about 40% by weight, about 45% by weight, about 50% by weight, about 55% by weight, about 60% by weight, about 65% by weight, about 70% by weight, about 75% by weight, about 80% by weight, about 85% by weight, or about 90% by weight. Liquid carriers include an amount of water on the higher end of the range. Solid carriers include an amount of water on the lower end of the range. Water helps to prevent solid carriers from becoming brittle.

The carrier may also include preservatives. Preservatives are preferred in carriers in which a natural surfactant constitutes most or all of the surfactant. The preservative is preferably an antioxidant. The preservative helps to prevent the surfactant from going rancid. Suitable preservatives include butylated hydroxytoluene, carrot root oil, grapefruit seed extract, rosemary extract, vitamin E or mixed tocopherols, vitamin A, vitamin C, propylene glycol, ureas such as diazolidinyl urea, parabens such as methylparaben and propylparaben, iodopropynyl butylcarbamate, phenoxyethanol, caprylyl glycol, and sorbic acid, among others. The preservative may be included in the carrier in an amount of from about 0.01% to about 10% by weight, of from about 0.1% to about 5% by weight, or of from about 0.5% to about 2.5% by weight.

The carrier may also include an antimicrobial. The antimicrobials are compounds or products capable of killing bacteria, viruses, and fungi. Preferred antimicrobial ingredients include triclocarban and triclosan. The antimicrobial may be included in the carrier in an amount effective to kill a bacterium, a virus, or a fungus. Examples of suitable amounts include from about 0.01% to about 10% by weight, from about 0.01% to about 2% by weight, or from about 0.1% to about 1% by weight.

The carrier may also include an emollient. The emollients may include any known emollients known in the art. Exemplary emollients include non-saponified fats (solid or liquid (oil)), honey, lecithin, lanolin, glycerin, cocoa-butter, shea butter, vegetable oils, plant oils, propylene glycol, polyethylene glycol, beeswax, lanolin, mineral oils, and infused oils. The emollient may be included in the carrier in an amount to produce a moisturizing effect on the skin. Examples of suitable amounts include from about 0.5% to about 50% by weight.

The carrier may also include a whitener. Titanium dioxide and zinc oxide are examples of suitable whiteners. The whitener may be included in the carrier in an amount of from about 0.001% to about 2% by weight.

The carrier may also include a chelating agent. The chelating agent may be used to bind minerals such as calcium and magnesium to soften water and soap, prevent so-called "soap scum," and increase the foaming and cleaning performance of the soap. Examples of suitable chelating agents include pentasodium pentetate, tetrasodium etidronate, sodium citrate, and ethylenediaminetetraacetic acid (EDTA), among others. The chelating may be included in the carrier in an amount of from about 0.001 to about 0.01% to about 10% by weight, from about 0.01% to about 2% by weight, or from about 0.1% to about 1% by weight.

In addition to the foregoing ingredients, the carrier may include any other ingredient known in the art or described in the following examples. For example, the carrier may include perfumes, fragrances, coloring, aloe, honey, oatmeal, salicylic acid, etc.

The carrier may comprise or consist of a liquid phase, semi-solid phase (as in gels), or a solid phase. Methods of generating liquid versus solid soaps, for example, are well-known in the art.

In addition to the carrier, the exfoliating compositions of the invention preferably comprise particles insoluble in the carrier as an exfoliant.

The insoluble particles preferably have a calcium carbonate equivalent (CCE) of less than 90%, preferably less than about 95%, more preferably less than about 90%, more preferably less than about 85%, more preferably less than about 80%, more preferably less than about 75%, and most preferably less than about 70%. The insoluble particles preferably have a CCE of greater than about 40%, more preferably greater than about 50%, more preferably greater than about 55%, more preferably greater than about 60%, and most preferably greater than about 65%. CCE is an expression of the acid-neutralizing capacity of a carbonate rock relative to that of pure calcium carbonate (calcite). It is expressed as a percentage of the acid-neutralizing capacity of calcite. For example, the CCE of pure calcite is 100%, and the CCE of pure dolomite is 108.5%. The CCE of pure dolomite is higher than 100% because the magnesium carbonate present in dolomite has a higher neutralizing capacity than pure calcium carbonate. Methods of determining CCE are well known in the art.

The insoluble particles preferably comprise calcium carbonate ($CaCO_3$). The calcium carbonate is preferably present in an amount of from about 40% to about 90%, preferably about 45% to about 80%, more preferably of from about 55% to about 75%, and most preferably of from about 60% to about 67% by mass. The calcium carbonate is preferably in the form of calcite.

The insoluble particles preferably comprise one or more phyllosilicates.

Phyllosilicates, or sheet silicates, are minerals that form parallel sheets of silicate tetrahedra. The sheets comprise $Si_2O_5$ or Si and O in a 2:5 ratio. Phyllosilicates are classified under the Nickel-Strunz classification of 09.E. It is thought that the presence of phyllosilicates in the insoluble particles impart a schistose shape to the particles. The phyllosilicates are preferably aluminum-containing phyllosilicates. Examples of suitable phyllosilicates include serpentine group phyllosilicates, such as antigorite ($Mg_3Si_2O_5(OH)_4$), chrysotile ($Mg_3Si_2O_5(OH)_4$), and lizardite ($Mg_3Si_2O_5(OH)_4$); clay mineral group phyllosilicates, such as halloysite ($Al_2Si_2O_5(OH)_4$), kaolinite ($Al_2Si_2O_5(OH)_4$), illite ($(K,H_3O)(Al,Mg,Fe)_2(Si,Al)_4O_{10}[(OH)_2,(H2O)]$), montmorillonite ($(Na,Ca)_{0.33}(Al,Mg)_2Si_4O_{10}(OH)_2.nH2O$), vermiculite ($(MgFe,Al)_3(Al,Si)_4O_{10}(OH)_2.\ 4H2O$), talc ($Mg_3Si_4O_{10}(OH)_2$), palygorskite ($(Mg,Al)_2Si_4O_{10}(OH).4(H2O)$), and pyrophyllite ($Al_2Si_4O_{10}(OH)_2$); mica group phyllosilicates, such as biotite ($K(Mg,Fe)_3(AlSi_3)O_{10}(OH)_2$), muscovite ($KAl_2(AlSi_3)O_{10}(OH)_2$), phlogopite ($KMg_3(AlSi_3)O_{10}(OH)_2$), lepidolite ($K(Li,Al)_{2-3}(AlSi_3)O_{10}(OH)_2$), margarite ($CaAl_2(Al_2Si_2)O_{10}(OH)_2$), and glauconite ($(K,Na)(Al,Mg,Fe)_2(Si,Al)_4O_{10}(OH)_2$); and chlorite group phyllosilicates, such as chlorite ($(Mg,Fe)_3(Si,Al)_4O_{10}(OH)_2.(Mg,Fe)_3(OH)_6$; or $(Mg,Fe,Al)_6(Si,Al)_4O_{10}(OH)$). In some versions, the one or more phyllosilicates are selected from illite, mica group phyllosilicates, and chlorite group phyllosilicates. In some versions, the one or more phyllosilicates are selected from the group consisting of illite, mica group phyllosilicates, and chlorite. In some versions, the one or more phyllosilicates consist of illite, mica group phyllosilicates, and chlorite group phyllosilicates. In some versions, the one or more phyllosilicates consist of illite, mica group phyllosilicates, and chlorite. In some versions, the insoluble particles comprise less than about 5%, less than about 1%, less than about 0.1%, less than about 0.01%, or about 0% (i.e., are substantially devoid) by mass of a serpentine group phyllosilicate, halloysite, kaolinite, montmorillonite, vermiculite, talc, palygorskite, and/or pyrophyllite. The phrase "comprise less than" when use with respect to an amount of a substance greater than 0% does not mean that the substance must contain any of the substance. In other words, the phrase "comprise less than" when use with respect to an amount of a substance greater than 0 may encompass particles that are substantially devoid of the substance. The one or more phyllosilicates are preferably included in the insoluble particles in a total amount of from about 1% to about 50%, more preferably of from about 5% to about 50%, more preferably of from about 8.5% to about 34%, and most preferably of from about 14% to about 20% by mass.

The insoluble particles preferably comprise at least a phyllosilicate selected from the group consisting of illite and mica group phyllosilicates, such as minerals having the formula $(K,Na,\ Ca)(Al,Mg,Fe)_2(Si,Al)_4O_{10}(OH,F)_2$, in a total amount of from about 1% to about 35%, more preferably of from about 5% to about 25%, more preferably of from about 5% to about 20%, and most preferably of from about 8% to about 14% by mass.

The insoluble particles preferably comprise at least a chlorite group phyllosilicate, such as chlorite ($((Mg,Fe)_3(Si,Al)_4O_{10}(OH)_2.(Mg,Fe)_3(OH)_6$; or $(Mg,Fe,Al)_6(Si,Al)_4O_{10}(OH))$), in a total amount of from about 0.1% to about 30%, more preferably of from about 0.5% to about 20%, more preferably of from about 1% to about 15%, more preferably of from about 1% to about 10% by mass, and most preferably of from about 3% to about 9% by mass.

The insoluble particles preferably comprise a quartz group tectosilicate. Tectosilicates, or "framework silicates," have a three-dimensional framework of silicate tetrahedra comprising $SiO_2$ or Si and 0 in a 1:2 ratio. Tectosilicates, with the exception of the quartz group, are aluminosilicates. Tectosilicates are classified under the Nickel-Strunz classification of 09.F and 09.G, 04.DA. Examples of suitable quartz group silicates include quartz, tridymite, cristobalite, and coesite, each of which are characterized by the formula $SiO_2$. Quartz is a preferred quartz group silicate. The insoluble particles preferably comprise aluminosilicate tectosilicates (i.e., non-quartz group tectosilicates) in an amount less than about 5%, less than about 1%, less than about 0.1%, less than about 0.01%, or about 0% (i.e., are substantially devoid) by mass. The quartz group tectosilicates are preferably present in the insoluble particles in an amount of from about 1% to about 35%, more preferably of from about 1% to about 25%, more preferably of from about 1% to about 20%, more preferably of from about 5% to about 15%, and most preferably of from about 7% to about 13% by mass.

The insoluble particles preferably comprise less than about 10% dolomite ($Ca(Mg,Fe)(CO_3)_2$), more preferably less than about 7% dolomite, more preferably less than about 6% dolomite, and most preferably less than about 5% dolomite. In some versions, the insoluble particles are substantially devoid of dolomite. In some versions, the insoluble particles comprise dolomite.

The insoluble particles preferably comprise less than about 5% pyrite ($FeS_2$), more preferably less than about 2.5% pyrite, and most preferably less than about 1% pyrite. In some versions, the insoluble particles are substantially devoid of pyrite. In some versions, the insoluble particles comprise pyrite.

The insoluble particles preferably comprise less than about 5% siderite ($FeCO_3$), more preferably less than about 2.5% siderite, more preferably less than about 1% siderite, more preferably less than about 0.1% siderite, more preferably less than about 0.01% siderite, and most preferably about 0% siderite (i.e., are substantially devoid of siderite).

The insoluble particles preferably comprise less than about 5% plagioclase feldspar ($(Na,Ca)Al(Si,Al)_3O_8$), more preferably less than about 2.5% plagioclase feldspar, more preferably less than about 1% plagioclase feldspar, and most preferably about 0% plagioclase feldspar (i.e., are substantially devoid of plagioclase feldspar).

The insoluble particles preferably comprise less than about 5% K-feldspar ($KAlSi_3O_8$), more preferably less than about 2.5% K-feldspar, more preferably less than about 1% side K-feldspar rite, more preferably less than about 0.1% K-feldspar, more preferably less than about 0.01% K-feldspar, and most preferably about 0% K-feldspar (i.e., are substantially devoid of K-feldspar).

The insoluble particles preferably comprise less than about 5% clinoamphibole ($Ca_2(Mg,Fe)_5Si_8O_{22}(OH)_2$), more preferably less than about 2.5% clinoamphibole, more preferably less than about 1% clinoamphibole, more preferably less than about 0.1% clinoamphibole, more preferably less than about 0.01% clinoamphibole, and most preferably about 0% clinoamphibole (i.e., are substantially devoid of clinoamphibole).

The insoluble particles preferably comprise less than about 5% orthoamphibole ($(Mg,Fe)_7Si_8O_{22}(OH)_2$), more preferably less than about 2.5% orthoamphibole, more preferably less than about 1% orthoamphibole, more preferably less than about 0.1% orthoamphibole, more preferably less than about 0.01% orthoamphibole, and most preferably about 0% orthoamphibole (i.e., are substantially devoid of orthoamphibole).

The insoluble particles preferably comprise total sodium (Na) or ions thereof, either bound, free, or bound and free, in an amount of from about 0.05% to about 1.5%, of from about 0.1% to about 1%, of from about 0.2% to about 0.4%, or of from about 0.25% to about 0.35%.

The insoluble particles preferably comprise total magnesium (Mg) or ions thereof, either bound, free, or bound and free, in an amount of from about 0.4% to about 10%, of from about 0.6% to about 6%, of from about 1.3% to about 3%, or of from about 1.6% to about 2.3%.

The insoluble particles preferably comprise total aluminum (Al) or ions thereof, either bound, free, or bound and free, in an amount of from about 0.6% to about 16%, of from about 1% to about 10%, of from about 2% to about 5%, or of from about 2.7% to about 3.9%.

The insoluble particles preferably comprise total silicon (Si) or ions thereof, either bound, free, or bound and free, in an amount of from about 1.7% to about 42%, of from about 2.8% to about 25%, of from about 5.5% to about 13%, or of from about 7% to about 10%.

The insoluble particles preferably comprise total phosphorus (P) or ions thereof, either bound, free, or bound and free, in an amount of from about 0.004% to about 0.1%, of from about 0.007% to about 0.06%, of from about 0.013% to about 0.03%, or of from about 0.017% to about 0.02%.

The insoluble particles preferably comprise total sulfur (S) or ions thereof, either bound, free, or bound and free, in an amount of from about 0.03% to about 0.9%, of from about 0.06% to about 0.5%, of from about 0.11% to about 0.25%, or of from about 0.14% to about 0.20%.

The insoluble particles preferably comprise total chlorine (Cl) or ions thereof, either bound, free, or bound and free, in an amount of from about 0.004% to about 0.1%, of from about 0.007% to about 0.06%, of from about 0.013% to about 0.03%, or of from about 0.017% to about 0.02%.

The insoluble particles preferably comprise total potassium (K) or ions thereof, either bound, free, or bound and free, in an amount of from about 0.25% to about 6%, of from about 0.42% to about 4%, of from about 0.85% to about 2%, or of from about 1% to about 1.5%.

The insoluble particles preferably comprise total calcium (Ca) or ions thereof, either bound, free, or bound and free, in an amount of from about 10% to about 40%, of from about 15% to about 35%, or of from about 20% to about 30%.

The insoluble particles preferably comprise total titanium (Ti) or ions thereof, either bound, free, or bound and free, in an amount of from about 0.03% to about 0.8%, of from about 0.05% to about 0.5%, of from about 0.10% to about 0.3%, or of from about 0.13% to about 0.2%.

The insoluble particles preferably comprise total manganese (Mn) or ions thereof, either bound, free, or bound and free, in an amount of from about 0.002% to about 0.05%, of from about 0.003% to about 0.03%, of from about 0.007% to about 0.02%, or of from about 0.008% to about 0.01%.

The insoluble particles preferably comprise total iron (Fe) or ions thereof, either bound, free, or bound and free, in an amount of from about 0.3% to about 9%, of from about 0.6% to about 5%, of from about 1.2% to about 2.5%, or of from about 1.5% to about 2%.

The insoluble particles preferably comprise total barium (Ba) or ions thereof, either bound, free, or bound and free, in an amount of from about 0.006% to about 0.15%, of from about 0.01% to about 0.09%, of from about 0.02% to about 0.05%, or of from about 0.025% to about 0.04%.

The insoluble particles may comprise vanadium (V), chromium (Cr), cobalt (Co), nickel (Ni), tungsten (W), copper (Cu), zinc (Zn), arsenic (As), tin (Sn), lead (Pb), molybdenum (Mo), uranium (U), thorium (Th), niobium (Nb), zirconium (Zr), rubidium (Rb), and/or yttrium (Y). The insoluble particles may comprise these elements in amounts of from about 0.1 to about 1000 parts per million each, such as about 1 to about 100 parts per million each. The insoluble particles may comprise strontium (Sr). The insoluble particles may comprise strontium in an amount from about 100 to about 10,000 parts per million, such as from about 200 to about 5,000 parts per million, or about 500 to about 2,000 parts per million.

In various versions of the invention, the insoluble particles may be sized such that at least about 80%, about 90%, or about 100% by mass of the particles are capable of passing through a 3.4-mm sieve (6 U.S. Standard mesh sieve); about 80%, about 90%, or about 100% by mass of the particles are capable of passing through a 2.8-mm sieve (7 U.S. Standard mesh sieve); about 80%, about 90%, or about 100% by mass of the particles are capable of passing through a 2.4-mm sieve (8 U.S. Standard mesh sieve); about 80%, about 90%, or about 100% by mass of the particles are capable of passing through a 2.0-mm sieve (10 U.S. Standard mesh sieve); about 80%, about 90%, or about 100% by mass of the particles are capable of passing through a 1.7-mm sieve (12 U.S. Standard mesh sieve); about 80%, about 90%, or about 100% by mass of the particles are capable of passing through a 1.4-mm sieve (14 U.S. Standard mesh sieve); about 80%, about 90%, or about 100% by mass of the particles are capable of passing through a 1.2-mm sieve (16 U.S. Standard mesh sieve); about 80%, about 90%, or about 100% by mass of the particles are capable of passing through a 1.0-mm sieve (18 U.S. Standard mesh sieve); about 80%, about 90%, or about 100% by mass of the particles are capable of passing through a 0.84-mm sieve (20 U.S. Standard mesh sieve); about 80%, about 90%, or about 100% by mass of the particles are capable of passing through a 0.71-mm sieve (25 U.S. Standard mesh sieve); or about 80%, about 90%, or about 100% by mass of the particles are capable of passing through a 0.60-mm sieve (30 U.S. Standard mesh sieve). Depending on the source of the particles and their original size, the sizes described above can be achieved by sieving with appropriate-sized sieves.

In a preferred version, at least about 80% by mass of the particles are capable of passing through a 1.0-mm sieve (18 U.S. Standard mesh sieve), at least about 75% by mass are capable of passing through a 0.60-mm sieve (30 U.S. Standard mesh sieve), at least about 70% by mass are capable of passing through a 0.30-mm sieve (50 U.S. Standard mesh sieve), at least about 65% by mass are capable of passing through a 0.15-mm sieve (100 U.S. Standard mesh sieve), and at least about 55% by mass are capable of passing through a 0.074-mm sieve (200 U.S. Standard mesh sieve).

In a more preferred version, at least about 90% by mass of the particles are capable of passing through a 1.0-mm sieve (18 U.S. Standard mesh sieve), at least about 80% by mass are capable of passing through a 0.60-mm sieve (30 U.S. Standard mesh sieve), at least about 75% by mass are capable of passing through a 0.30-mm sieve (50 U.S. Standard mesh sieve), at least about 70% by mass are capable of passing through a 0.15-mm sieve (100 U.S. Standard mesh sieve), and at least about 60% by mass are capable of passing through a 0.074-mm sieve (200 U.S. Standard mesh sieve).

In a most preferred version, about 100% by mass of the particles are capable of passing through a 1.0-mm sieve (18 U.S. Standard mesh sieve), at least about 90% by mass are capable of passing through a 0.60-mm sieve (30 U.S. Standard mesh sieve), at least about 85% by mass are capable of passing through a 0.30-mm sieve (50 U.S. Standard mesh sieve), at least about 80% by mass are capable of passing through a 0.15-mm sieve (100 U.S. Standard mesh sieve), and at least about 70% by mass are capable of passing through a 0.074-mm sieve (200 U.S. Standard mesh sieve).

In some versions, at least about 5% by mass of the particles are capable of being retained by a 1.0-mm sieve (18 U.S. Standard mesh sieve), at least about 10% by mass are capable of being retained by a 0.60-mm sieve (30 U.S. Standard mesh sieve), at least about 15% by mass are capable of being retained by a 0.30-mm sieve (50 U.S. Standard mesh sieve), at least about 20% by mass are capable of being retained by a 0.15-mm sieve (100 U.S. Standard mesh sieve), and at least about 30% by mass are capable of being retained by a 0.074-mm sieve (200 U.S. Standard mesh sieve).

In some versions, at least about 1% by mass are capable of being retained by a 0.60-mm sieve (30 U.S. Standard mesh sieve), at least about 5% by mass are capable of being retained by a 0.30-mm sieve (50 U.S. Standard mesh sieve), at least about 10% by mass are capable of being retained by a 0.15-mm sieve (100 U.S. Standard mesh sieve), and at least about 20% by mass are capable of being retained by a 0.074-mm sieve (200 U.S. Standard mesh sieve).

The insoluble particles preferably comprise a foliated (planar) texture, as opposed to a granular texture. The foliated texture is preferably a schistose texture.

The insoluble particles preferably have a hardness on the Mohs Hardness Scale of from about 2 to about 4, and more preferably of from about 2.5 to about 3.5.

The insoluble particles are preferably fines from quarry mining that are not substantially modified in composition, i.e., are not synthetic particles.

The water insoluble particle is present in the exfoliating composition in an amount of from about 1% to about 95% by weight. In various versions of the invention, the insoluble particles may be present in an amount of at least about 1%, about 5%, about 10%, about 15%, about 20%, about 25%, about 30%, about 35%, about 40%, about 45%, about 50%, about 55%, about 60%, about 65%, about 70%, about 75%, about 80%, about 85%, or about 90% by weight. In various versions of the invention, the insoluble particles may additionally or alternatively be present in an amount no more than about 95%, about 90%, about 85%, about 80%, about 75%, about 70%, about 65%, about 60%, about 55%, about 50%, about 45%, about 40%, about 35%, about 30%, about 25%, about 20%, about 15%, about 10%, about 5%, or about 1% by weight.

In some versions of the invention, the insoluble particle is evenly dispersed within the carrier. In some versions of the invention, the insoluble particle is unevenly dispersed within the carrier.

In some versions of the invention, the carrier may further comprise exfoliants other than the insoluble particles described herein. Such exfoliants may include ground oats, bran, almond meal, cinnamon, corn meal, poppy seeds, pumice, and sand, among others.

The invention further provides methods of using the exfoliating compositions as described herein as well as methods of preparing the exfoliating compositions as described herein. See, e.g., the following examples.

The amounts specified herein refer to mass (i.e., mass % or percent mass, etc.), unless explicitly stated otherwise.

The elements and method steps described herein can be used in any combination whether explicitly described or not.

All combinations of method steps as used herein can be performed in any order, unless otherwise specified or clearly implied to the contrary by the context in which the referenced combination is made.

As used herein, the singular forms "a," "an," and "the" include plural referents unless the content clearly dictates otherwise.

Numerical ranges as used herein are intended to include every number and subset of numbers contained within that range, whether specifically disclosed or not. Further, these numerical ranges should be construed as providing support for a claim directed to any number or subset of numbers in that range. For example, a disclosure of from 1 to 10 should be construed as supporting a range of from 2 to 8, from 3 to 7, from 5 to 6, from 1 to 9, from 3.6 to 4.6, from 3.5 to 9.9, and so forth.

All patents, patent publications, and peer-reviewed publications (i.e., "references") cited herein are expressly incorporated by reference to the same extent as if each individual reference were specifically and individually indicated as being incorporated by reference. In case of conflict between the present disclosure and the incorporated references, the present disclosure controls.

It is understood that the invention is not confined to the particular construction and arrangement of parts herein illustrated and described, but embraces such modified forms thereof as come within the scope of the claims.

EXAMPLES

Example 1

Background

Exfoliating skin compositions, such as soaps and mud scrubs, were made with quarry marble waste fines from the Lawyers Road Quarry of Boxley Materials Company (15418 West Lynchburg Salem Turnpike, Blue Ridge, Va. 24064) as an exfoliant. The Lawyers Road Quarry is located at 762 Lawyers Road, Lynchburg, Va. 24501. The marble waste fines from this quarry are referred to hereafter as "Lawyers Road fines." The skin compositions made with the Lawyers Road fines left the skin much softer, moister, and silkier than comparable compositions with other exfoliants.

Example 2

Compositional Analysis of Lawyers Road Fines

To determine the content of the Lawyers Road fines, elemental analysis was performed using X-ray fluorescence (XRF). A representative portion of the fines was ground to approximately −400 mesh in a steel swing mill and then analyzed with a standard XRF procedure for 31 major, minor and trace elements. The relative precision/accuracy for this procedure is ~5-10% for major-minor elements and ~10-15% for trace elements (those elements listed in ppm) at levels greater than twice the detection limit in samples of average geologic composition. A replicate sample and a standard reference material ("GSP-2" a USGS standard rock) were analyzed with the samples to demonstrate analytical reproducibility for the samples and analytical accuracy for a geologic standard, respectively. The accepted ("known") values for the quality control standard are listed with the XRF results, as shown below in Table 1 and Table 2. The results in Table 1 indicate that the Lawyers Road fines contain totals of about 0.29% sodium (Na), 1.92% magnesium (Mg), 3.22% aluminum (Al), 8.45% silicon (Si), less than 0.02% phosphorus (P), 0.17% sulfur (S), less than 0.02% chloride (Cl), 1.27% potassium (K), 28.4% calcium (Ca), 0.16% titanium (Ti), 0.01% manganese (Mn), 1.74% iron (Fe), and 0.03% barium (Ba).

TABLE 1

Elemental analysis of Lawyers Road fines as determined by XRF. Material was determined in weight percentage (Wt %) per sample.

| Elemental composition | Wt % | Wt % replicate | GSP-2-XRF | GSP-2-known |
|---|---|---|---|---|
| $Na_2O$ | 0.39 | 0.39 | 2.99 | 2.78 |
| MgO | 3.18 | 3.20 | 1.14 | 0.96 |
| $Al_2O_3$ | 6.09 | 6.09 | 14.3 | 14.9 |
| $SiO_2$ | 18.1 | 18.1 | 68.6 | 66.6 |
| $P_2O_5$ | <0.05 | <0.05 | 0.30 | 0.29 |
| S | 0.17 | 0.17 | <0.05 | — |
| Cl | <0.02 | <0.02 | <0.02 | — |
| $K_2O$ | 1.53 | 1.53 | 5.77 | 5.38 |
| CaO | 39.7 | 39.7 | 2.10 | 2.10 |
| $TiO_2$ | 0.26 | 0.26 | 0.66 | 0.66 |
| $MnO_2$ | 0.02 | 0.02 | 0.04 | 0.04 |
| $Fe_2O_3$ | 2.48 | 2.48 | 4.94 | 4.90 |
| BaO | 0.03 | 0.03 | 0.15 | 0.15 |

TABLE 2

Elemental composition of Lawyers Road fines as determined by XRF. Material was measured in parts per million (ppm) per sample.

| Chemical Element | ppm | ppm replicate | GSP-2-XRF | GSP-2-known |
|---|---|---|---|---|
| V | 51 | 53 | 60 | 52 |
| Cr | 48 | 48 | 22 | 20 |
| Co | 11 | 12 | <10 | 7 |
| Ni | 16 | 16 | 13 | 17 |
| W | <10 | <10 | <10 | — |
| Cu | 22 | 23 | 47 | 43 |
| Zn | 33 | 32 | 124 | 120 |
| As | <20 | <20 | <20 | — |
| Sn | <50 | <50 | <50 | — |
| Pb | 11 | 11 | 45 | 42 |
| Mo | <10 | <10 | <10 | — |
| Sr | 911 | 898 | 231 | 240 |
| U | <20 | <20 | <20 | 2 |
| Th | <20 | <20 | 83 | 105 |
| Nb | <10 | <10 | 23 | 27 |
| Zr | 62 | 63 | 576 | 550 |
| Rb | 31 | 28 | 206 | 245 |
| Y | <10 | 10 | 36 | 28 |

Mineral analysis was also performed. A portion of the ground sample was packed into a well-type plastic holder and then scanned with a diffractometer over the range, 3-61° 2Θ using Cu—Kα radiation. The results of the scans are summarized as approximate mineral weight concentrations in Table 3. Estimates of mineral concentrations were made using the XRF-determined elemental compositions and the relative peak areas on X-ray diffraction (XRD) scans. The detection limit for an average mineral in these samples is ~1-3% and the analytical reproducibility is approximately equal to the square root of the amount.

TABLE 3

Mineral composition of Lawyers Road fines. Material was determined in weight percentage (Wt %) per sample.

| Mineral Name | Chemical Formula | Approx. Wt % |
|---|---|---|
| Calcite | $CaCO_3$ | 85 |
| Dolomite | $Ca(Mg, Fe)(CO_3)_2$ | <5 |
| Siderite | $FeCO_3$ | — |
| Quartz | $SiO_2$ | 10 |
| Mica/Illite | $(K, Na, Ca)(Al, Mg, Fe)_2(Si, Al)_4O_{10}(OH, F)_2$ | 11 |
| Chlorite | $(Mg, Fe, Al)_6(Si, Al)_4O_{10}(OH)$ | 6 |
| Plagioclase feldspar | $(Na, Ca)Al(Si, Al)_3O_8$ | — |
| K-feldspar | $KAlSi_3O_8$ | — |
| Clinoamphibole | $Ca_2(Mg, Fe)_5Si_8O_{22}(OH)_2$ | — |
| Orthoamphibole | $(Mg, Fe)_7Si_8O_{22}(OH)_2$ | — |
| Pyrite | $FeS_2$ | <1 |
| Unidentified | ? | <5 |

"Unidentified" accounts for that portion of the XRD scan which could not be resolved and a "?" indicates doubt in both mineral identification and amount.

The Lawyer Road fines were also subjected to compositional analysis by Waters Agricultural Laboratories, Inc., Kentucky. The Lawyer Road fines were determined to comprise 24.9% calcium, 1.5% total magnesium, 62.1% calcium carbonate, and 5.2% magnesium carbonate and to have a calcium carbonate equivalent (CCE) of 68%.

From the above analyses, the Lawyers Road fines were determined to contain a significant amount of calcium carbonate mixed with quartz, mica/illite, and chlorite. Based on the mineral composition, the Lawyers Road fines have an estimated hardness of about 3.2 on the Mohs Hardness Scale.

Example 4

Size and Shape Analysis of the Lawyers Road Fines

The Lawyers Road fines were subjected to a size distribution analysis by sequential sieving through sieves decreasing in size. The results are shown in Table 4.

TABLE 4

Size analysis of Lawyers Road fines.

| Size Sieve | Individual Weight (g) | Percent Retained (%) | Cumulative Weight (g) | Percent Pass (%) |
|---|---|---|---|---|
| ⅜ | 0 | 0 | 0 | 100 |
| #4 | 7.8 | 3.26 | 7.8 | 96.7 |
| #8 | 8 | 3.35 | 15.8 | 93.4 |
| #16 | 16.6 | 6.94 | 32.4 | 86.5 |
| #30 | 10.2 | 4.27 | 42.6 | 82.2 |
| #50 | 8 | 3.35 | 50.6 | 78.9 |
| #100 | 12 | 5.02 | 62.6 | 73.9 |
| #200 | 23.1 | 9.66 | 85.7 | 64.2 |
| Total starting weight: 239.1 g | | | | |

Sieve sizes refer to U.S. Standard mesh size.

"Individual weight" refers to the amount of material retained by each respective sieve, expressed as weight in grams.

"Percent retained" refers to the amount of material retained by each respective sieve, expressed as a percent of the total starting material.

"Cumulative weight" refers to the total amount of material retained by the cumulative sieving steps, expressed as weight in grams.

"Percent pass" refers to the amount of material passing through each sieve, expressed as a percent of the total starting material.

The Lawyers road fines exhibited a foliated, schistose texture.

Example 4

Preparation of Lawyers Road Fines for Exfoliating Skin Compositions

Buckets of sifted (<14 mm) Lawyers Road fines were obtained from Boxley Company (Lynchburg, Va.). The fines were resifted by hand using a household 1-mm-hole sieve. Nothing else was done to the Lawyers Road fines prior to stifling them into the skin compositions. The Lawyers Road fines both before and after resifting had a foliated, schistose texture.

Based on the original size distribution of the original Lawyers Road fines, as shown in Example 4, the size distributed on the of the 1-mm sifted fines would be such that about 100% by mass of the particles would be capable of passing through a 1.0-mm sieve (18 U.S. Standard mesh sieve), at least about or about 95% by mass would be capable of passing through a 0.60-mm sieve (30 U.S. Standard mesh sieve), at least about or about 91% by mass would be capable of passing through a 0.30-mm sieve (50 U.S. Standard mesh sieve), at least about or about 85% by mass would be capable of passing through a 0.15-mm sieve (100 U.S. Standard mesh sieve), and at least about or about 74% by mass would be capable of passing through a 0.074-mm sieve (200 U.S. Standard mesh sieve).

Example 5

Avocado Cucumber Soap

This example describes the making of a bar of soap with the Lawyers Road fines evenly distributed throughout the bar to ensure a uniform scrub experience.

Four ounces of pre-made Avocado Cucumber Soap from Life of the Party™ (North Brunswick, N.J.) were melted in a microwave for 30 seconds and then again in 10 second intervals until the soap was completely melted. The Avocado Cucumber Soap contained water, propylene glycol, sodium stearate, glycerin, sucrose, sodium laurel sulfate, inert suspending agent, titanium dioxide, stearic acid, sodium chloride, pentasodium pentetate, and tetrasodium etidronate. A single tablespoon of sifted Lawyers Road fines (<1 mm) was added to the hot, melted pre-made soap. Fragrance oil (0.5-1 ml) was also added to the melted soap. The solution was stirred vigorously. The stirred, melted soap was poured into 2-ounce soap molds pre-treated with rubbing alcohol and allowed to harden. Bars were pushed out of the molds after they cooled (approximately 40 minutes) and wrapped in plastic wrap until tested by the test subjects.

Example 6

Lotion Soap

Beeswax (4 oz.) was melted in a double boiler on the stove. Shea butter (4 oz.) and liquid oil (jojoba, 5 oz.) were melted in another double boiler. The beeswax and butter/oil mixtures were added together and mixed vigorously with 2 teaspoons of fragrance oil. Sifted Lawyers Road fines (<1 mm; 3 teaspoons) were added with mixing, and the mixture was poured into 2-ounce molds. The mixture hardened in approximately 1-2 hours. The bars were wrapped within plastic wrap until used.

Example 7

Shea Butter Soap

Shea butter (4 oz.) was melted in a double boiler. The shea butter, coconut oil (16 oz.), olive oil (18 oz.), and palm oil (16 oz.) were added together in a container and then added to tallow (16 oz.), lye (5% superfatted lye, 9.815 oz.) and water (23.1 oz.). Sifted (1 mm) Lawyers Road fines (<1 mm; 3 teaspoons) were added and stirred vigorously into the mixture. Once all components were melted and mixed, the mixture was poured into 2-ounce molds. The mixture hardened within in a few hours and bars were wrapped within plastic wrap until used.

Example 8

Glycerin-Based Soap

This soap does not evenly suspend the fines.

Four ounces of White Glycerin Soap from Life of the Party™ were melted in a microwave for 30 seconds and then again in 10 second intervals until completely melted. The White Glycerin Soap contained glycerin, sodium palmate, sodium cocoate, sorbitol, palm acid, coconut acid, pentasodium pentetate, tetrasodium elidronate, sodium palm kernelate, butyrospermum parkii (shea butter), sodium hydroxide, palm kernel acid, sodium citrate, titanium dioxide, sodium stearate, sodium laurate, propylene glycol, sodium laureth sulfate, goat milk, sodium lauryl sulfate, sodium chloride, stearic acid, and lauric acid. A single tablespoon of sifted Lawyers Road fines (<1 mm) was added to the hot, melted pre-made soap recipe. Fragrance oil (0.5-1 ml) was then added, and the solution was stirred vigorously. The melted soap was poured into soap molds pre-treated with rubbing alcohol and allowed to harden. Bars were pushed out of the molds after they cooled (approximately 40 minutes) and wrapped in plastic wrap until used.

Example 9

Mud Scrub

To 0.5 cup of sifted Lawyers Road fines (<1 mm), a cup of olive oil was added, and the contents were stirred and poured into a glass container for storage. To use the mud scrub, freshly stirred scrub was spread with a spoon or wooden applicator onto skin and washed off after scrubbing or massaging on the skin.

What is claimed is:

1. An exfoliating composition comprising:

a carrier comprising one of more of a surfactant and an emollient; and particles insoluble in the carrier that comprise calcium carbonate in an amount of from about 40% to about 90% by mass, one or more phyllosilicates in a total amount of from about 1% to about 50% by mass, a quartz group tectosilicate in an amount of from about 1% to about 35% by mass, and a calcium carbonate equivalent of less than about 90%.

2. The composition of claim 1 wherein the particles comprise the calcium carbonate in form of calcite in an amount of from about 55% to about 75% by mass.

3. The composition of claim 1 wherein the particles comprise a calcium carbonate equivalent of less than about 75%.

4. The composition of claim 1 wherein the one or more phyllosilicates comprise one or more of illite and a mica group phyllosilicate in a total amount of from about 1% to about 35% by mass.

5. The composition of claim 1 wherein the one or more phyllosilicates comprise a chlorite group phyllosilicate in an amount of from about 1% to about 15% by mass.

6. The composition of claim 1 wherein the one or more phyllosilicates comprise one or more of illite and a mica group phyllosilicate in a total amount of from about 1% to about 35% by mass and further comprise a chlorite group phyllosilicate in an amount of from about 1% to about 15% by mass.

7. The composition of claim 1 wherein the particles comprise less than about 1% by weight of each of a serpentine group phyllosilicate, halloysite, kaolinite, montmorillonite, vermiculite, talc, palygorskite, and pyrophyllite.

8. The composition of claim 1 wherein the particles comprise less than about 10% by weight of dolomite.

9. The composition of claim 1 wherein the particles comprise less than about 2.5% by weight of pyrite and less than about 1% by weight of each of siderite, plagioclase feldspar, K-feldspar, clinoamphibole, and orthoamphibole.

10. The composition of claim 1 wherein the particles embody a foliated texture.

11. The composition of claim 1 wherein the particles embody a schistose texture.

12. The composition of claim 1 wherein the particles comprise:

the calcium carbonate in a form of calcite in an amount of from about 55% to about 75% by mass;

a calcium carbonate equivalent of less than about 75%;

the one or more phyllosilicates as one or more of illite and a mica group phyllosilicate in a total amount of from about 1% to about 35% by mass and a chlorite group phyllosilicate in an amount of from about 1% to about 15% by mass;

the quartz group tectosilicate in an amount of from about 1% to about 20% by mass;

less than about 1% by weight of each of a serpentine group phyllosilicate, halloysite, kaolinite, montmorillonite, vermiculite, talc, palygorskite, and pyrophyllite;

less than about 10% by weight of dolomite;

less than about 2.5% by weight of pyrite; and less than about 1% by weight of each of siderite, plagioclase feldspar, K-feldspar, clinoamphibole, and orthoamphibole, wherein the particles embody a schistose texture.

13. The composition of claim 1 wherein the particles comprise:

the calcium carbonate in a form of calcite in an amount of from about 60% to about 67% by mass;

a calcium carbonate equivalent of from about 55% to about 75%;

the one or more phyllosilicates as one or more of illite and a mica group phyllosilicate in a total amount of from about 8% to about 14% by mass and a chlorite group phyllosilicate in an amount of from about 3% to about 9% by mass;

the quartz group tectosilicate in an amount of from about 7% to about 13% by mass;

less than about 5% by weight of dolomite; and less than about 1% of pyrite, wherein the particles are substantially devoid of each of a serpentine group phyllosilicate, halloysite, kaolinite, montmorillonite, vermiculite, talc, palygorskite, pyrophyllite, siderite, plagioclase feldspar, K-feldspar, clinoamphibole, and orthoamphibole, and wherein the particles embody a schistose texture.

14. The composition of claim 1 wherein the carrier further comprises one or more of a preservative, an antimicrobial, and a whitener.

15. The composition of claim 1 wherein the carrier is in a liquid phase form.

16. The composition of claim 1 wherein the carrier is in a solid phase form.

17. The composition of claim 1 wherein the particles are evenly dispersed within the carrier.

18. The composition of claim 1 wherein the particles are unevenly dispersed within the carrier.

19. The composition of claim 1 wherein at least about 90% by mass of the particles are capable of passing through a 0.60-mm sieve (30 U.S. Standard mesh sieve), at least about 85% by mass of the particles are capable of passing through a 0.30-mm sieve (50 U.S. Standard mesh sieve), at least about 80% by mass of the particles are capable of passing through a 0.15-mm sieve (100 U.S. Standard mesh sieve), and at least about 70% by mass of the particles are capable of passing through a 0.074-mm sieve (200 U.S. Standard mesh sieve), and wherein at least about 1% by mass of the particles are capable of being retained by a 0.60-mm sieve (30 U.S. Standard mesh sieve), at least about 5% by mass of the particles are capable of being retained by a 0.30-mm sieve (50 U.S. Standard mesh sieve), at least about 10% by mass of the particles are capable of being retained by a 0.15-mm sieve (100 U.S. Standard mesh sieve), and at least about 20% by mass of the particles are capable of being retained by a 0.074-mm sieve (200 U.S. Standard mesh sieve).

* * * * *